US007866236B2

(12) United States Patent
Hsu

(10) Patent No.: US 7,866,236 B2
(45) Date of Patent: Jan. 11, 2011

(54) AUTOMATIC SCREW FEEDING APPARATUS FOR POWER SCREWDRIVER

(75) Inventor: Ming-Hung Hsu, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 251 days.

(21) Appl. No.: 12/262,994

(22) Filed: Oct. 31, 2008

(65) Prior Publication Data

US 2010/0059541 A1 Mar. 11, 2010

(30) Foreign Application Priority Data

Sep. 8, 2008 (TW) ..... 97134465 A

(51) Int. Cl.
*B25B 23/04* (2006.01)

(52) U.S. Cl. ..... 81/434; 81/57.37

(58) Field of Classification Search ..... 81/433–435, 81/57.37, 57.23; 227/16, 107, 120, 146
See application file for complete search history.

(56) References Cited

U.S. PATENT DOCUMENTS 5,144,870 A * 9/1992 Nick ..... 81/434
6,915,724 B2 * 7/2005 Kigel et al. ..... 81/434
7,082,857 B1 8/2006 Hoffman
7,415,910 B2 * 8/2008 Arai ..... 81/57.37

* cited by examiner

*Primary Examiner*—David B Thomas
(74) *Attorney, Agent, or Firm*—Browdy and Neimark, PLLC

(57) ABSTRACT

An automatic screw feeding apparatus includes a base assembly, a slide assembly, a first spring, a screw carrier driving device, and a screw carrier guidance device. The slide assembly is mounted to the base assembly, movable forward and backward between a first position and a second position along a straight path. The first spring is mounted between the base and slide assemblies for keeping the slide assembly at the first position. The screw carrier guidance device includes a connection member connected with the base assembly, a guide member mounted to the connection member and movable forward and backward between a third position and a fourth position, and a second spring mounted between the guide and connection members for keeping the guide member located at the third position. The second spring can greatly lighten the load of the first spring to prevent the fed screws from being jammed.

19 Claims, 15 Drawing Sheets

AUTOMATIC SCREW FEEDING APPARATUS FOR POWER SCREWDRIVER

BACKGROUND OF THE INVENTION

1. Field of the Invention

The present invention relates generally to power tools, and more particularly, to an automatic screw feeding apparatus for a power screwdriver.

2. Description of the Related Art

A conventional screw feeding apparatus is mounted to a power screwdriver. When a user is operating the power screwdriver to screw screws onto a workpiece, a screw belt carrying a bunch of screws is automatically driven for movement along a fixed path and then the screws are conveyed to a front side of a screwdriver bit of the power screwdriver in turn to be driven by the driver bit for screw with the workpiece. In this way, the user does not have to put the screws one by one to a working position by one hand and to maintain them in position for screw with the workpiece by the power screwdriver, thus greatly shortening the required working time. Besides, the user can operate the power screwdriver by two hands to increase more safety for the operation.

U.S. Pat. No. 7,082,857 disclosed a portable screw driving tool including a housing portion, a feed tube mounted onto the housing portion, a slide body subassembly slidably mounted to the feed tube for forward and backward movement along the feed tube, and a sprocket mounted inside the slide body subassembly. The sprocket can be driven for rotation, while the slide body subassembly is moved backward, to drive a plastic strip in contact therewith to move forward along a predetermined path and then a plurality of screws carried by the plastic strip can be conveyed to a firing position one by one for screw with a workpiece by a drive bit of the portable screw driving tool.

The aforesaid portable screw driving tool further includes a movable guide defining a path that the plastic strip can be moved along. The movable guide is slidably mounted to the housing portion, having its front end fixed to the slide body subassembly whereby the movable guide is slidable forward and backward on the housing portion together with the slide body subassembly and then the plastic strip is also slidably moved to avoid bunching or tangling while the slide body subassembly is slidably moved.

Because the front end of the movable guide is fixed to the slide body subassembly and the primary part of the movable guide is mostly covered by the housing portion, the movable guide cannot be detached unless a tool is used and a lot of time is spent. In this way, the portable screw driving tool is too large to be conveniently portable for the user, also increasing the delivery cost.

The aforesaid portable screw driving tool further includes a spring located in the feed tube and having two ends contacting against the slide body subassembly and the housing portion respectively for pushing the slide body subassembly, the movable guide, the plastic strip, and the screws carried on the plastic strip back to the original position.

In such design, while the spring pushes the slide body subassembly, the movable guide, the plastic strip, and the screws back, the spring needs to overcome the resistance resulted from the forward movement of the plastic strip and the screws that are driven by the sprocket as well as the resistance resulted from the backward movement of the slide body subassembly, the movable guide, the plastic strip, and the screws. In this way, the spring is heavily loaded to cause unsmooth movement of the slide body subassembly, the movable guide, the plastic strip, and the screws and even to cause regular failure while the sprocket drives the plastic strip to further jam the screws while they are fed.

SUMMARY OF THE INVENTION

The primary objective of the present invention is to provide an automatic screw feeding apparatus, which does not jam the screws while they are fed.

The foregoing objective of the present invention is attained by the automatic screw feeding apparatus composed of a base assembly, a slide assembly, a first spring, a screw carrier driving device, and a screw carrier guidance device. The base assembly is adapted for connection with a power screwdriver. The slide assembly is slidably mounted to the base assembly, movable forward and backward between a first position and a second position along a straight path. The slide assembly includes a passage having a first inlet and a first outlet. One end of a screw carrier can enter the passage from the first inlet and exit the passage from the first outlet. The first spring is mounted between the base assembly and the slide assembly for keeping the slide assembly at the first position. The screw carrier driving device is mounted to the slide assembly for driving a screw carrier having a part located in the passage to move along the passage for a fixed distance while the slide assembly is moved to the second position from the first position. The screw carrier guidance device includes a connection member, a guide member, and at least one second spring. The connection member is mounted to the base assembly. The guide member has a first end, a second end, and a guide groove. The guide groove defines a second inlet and a second outlet. The second inlet is located at the first end of the guide member. The second outlet is located at the second end of the guide member. One end of the screw carrier can enter the guide groove from the second inlet and exit the guide groove from the second outlet. The guide member is movable forward and backward between a third position and a fourth position of the connection member. When the guide member is located at the third position, the second outlet is located close to the first inlet of the slide assembly for facilitating one end of the screw carrier to smoothly enter the passage from the second outlet through the first inlet. The second spring is mounted between the guide member and the connection member for keeping the guide member located at the third position.

Because the second spring can push the guide member, the screw carrier, and a plurality of screws carried on the screw carrier from the fourth position to the third position, the load of the first spring can be lightened to prevent the fed screws from being jammed.

The secondary objective of the present invention is to provide an automatic screw feeding apparatus, which is conveniently portable for the user to lower the delivery cost.

The foregoing objective of the present invention is attained by the above automatic screw feeding apparatus. The connection member is detachably connected with the base assembly. The slide assembly further includes main body and a first limit member. The main body is slidably mounted to the base assembly, movable forward and backward between the first position and the second position. The first limit member is a screw bolt having a body portion and a head portion, wherein the body portion is provide with a thread. The first limit member is threadably secured with the body portion of the first limit member, wherein a part of the body portion and the head portion are exposed outside the main body of the slide assembly. The guide member has a contact portion having a first surface, a second surface, and an open slot through the first and second surfaces and having a slot opening and a slot bottom. The open slot of the guide member is adapted for connection with the first limit member. When the guide member is located at the third position, the slot bottom lies against the exposed part of the body portion of the first limit member.

DETAILED DESCRIPTION OF PREFERRED EMBODIMENTS

Figure 1:
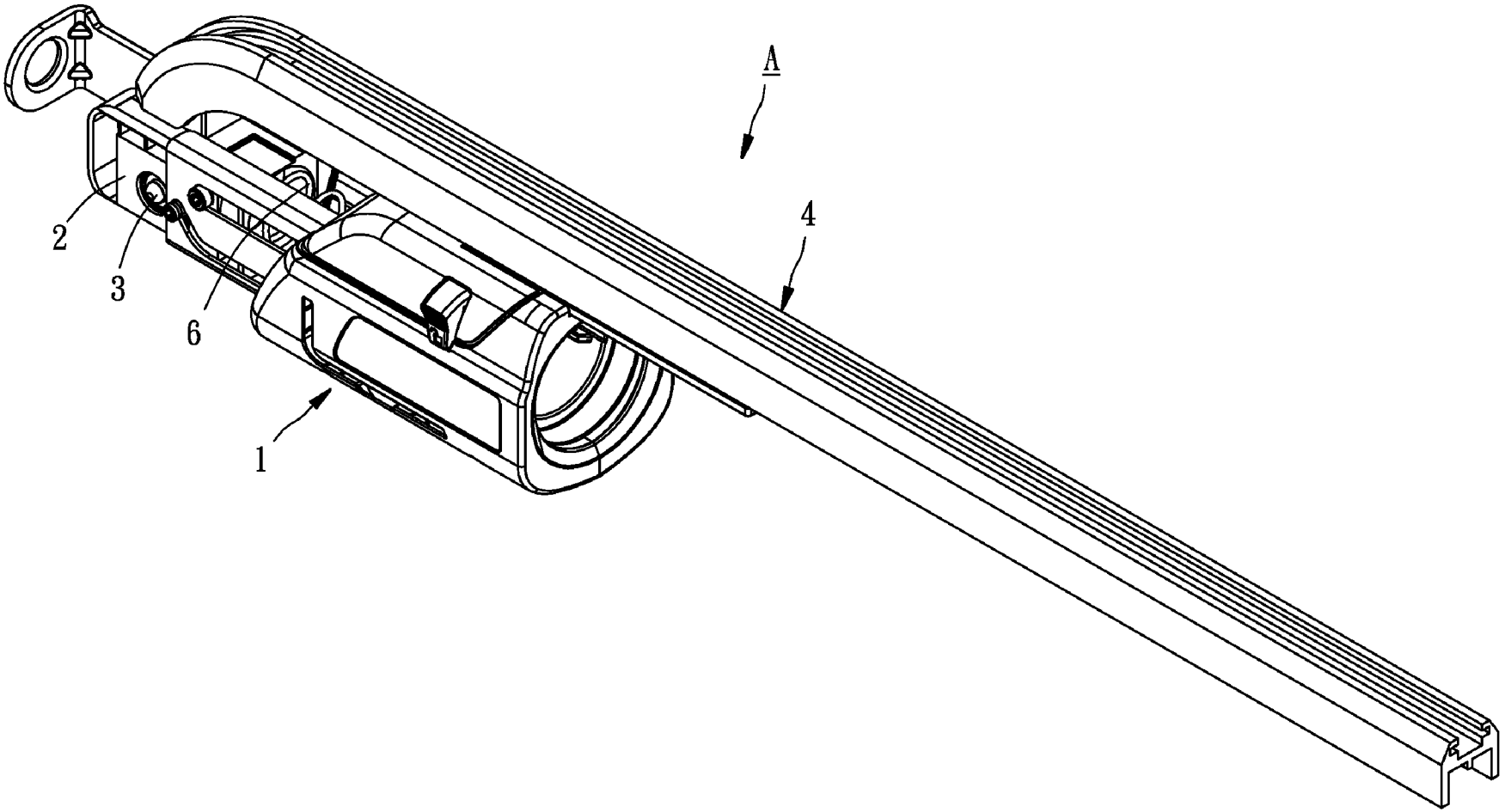
FIG. 1 is a perspective view of a first preferred embodiment of the present invention.

Referring to FIG. 1, an automatic screw feeding apparatus A constructed in accordance with a first preferred embodiment of the present invention is composed of a base assembly 1, a slide assembly 2, a first spring 6, a screw carrier driving device 3, and a screw carrier guidance device 4.

Figure 2:
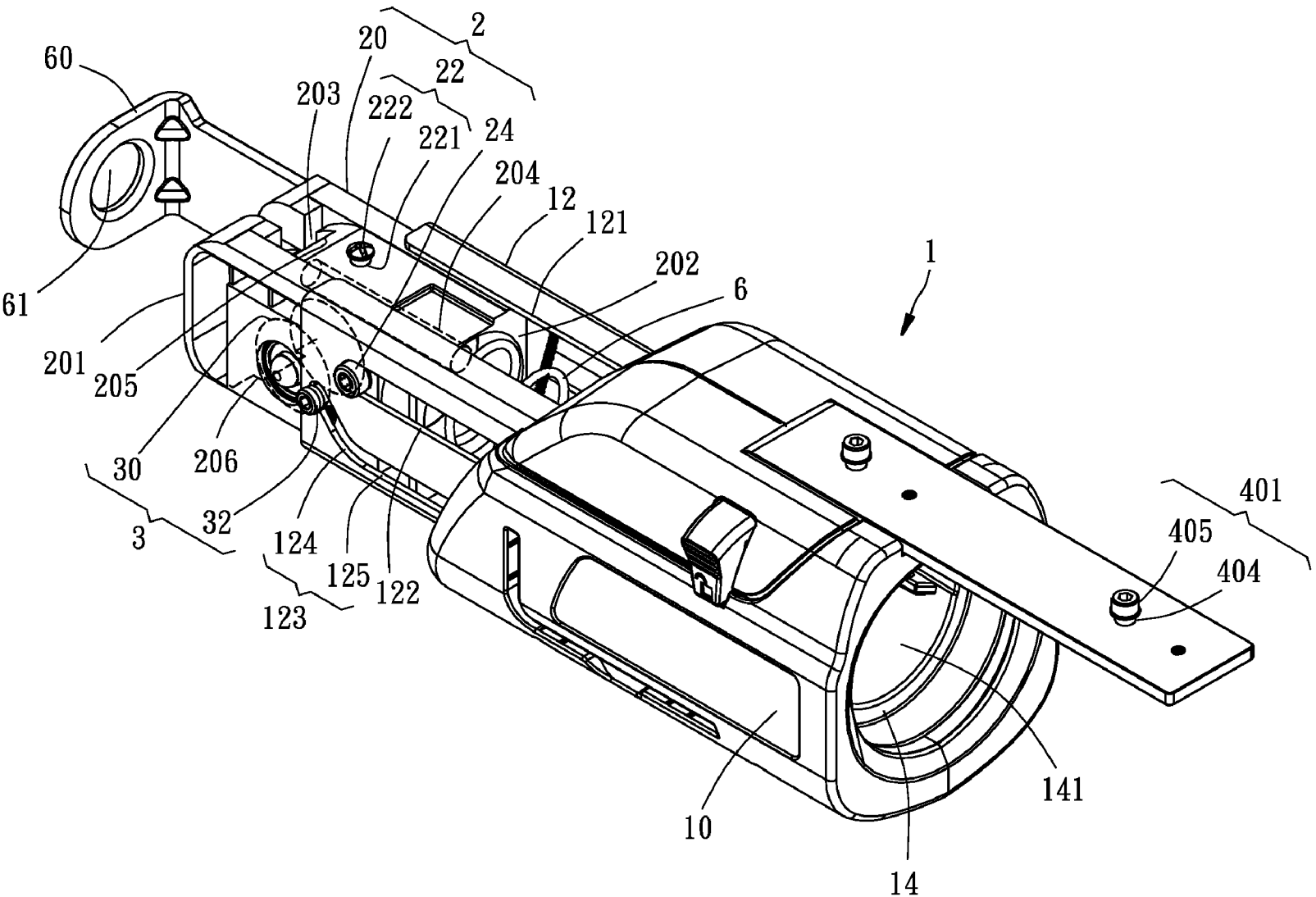
FIG. 2 is a perspective view of a part of the first preferred embodiment of the present invention.
Figure 3:
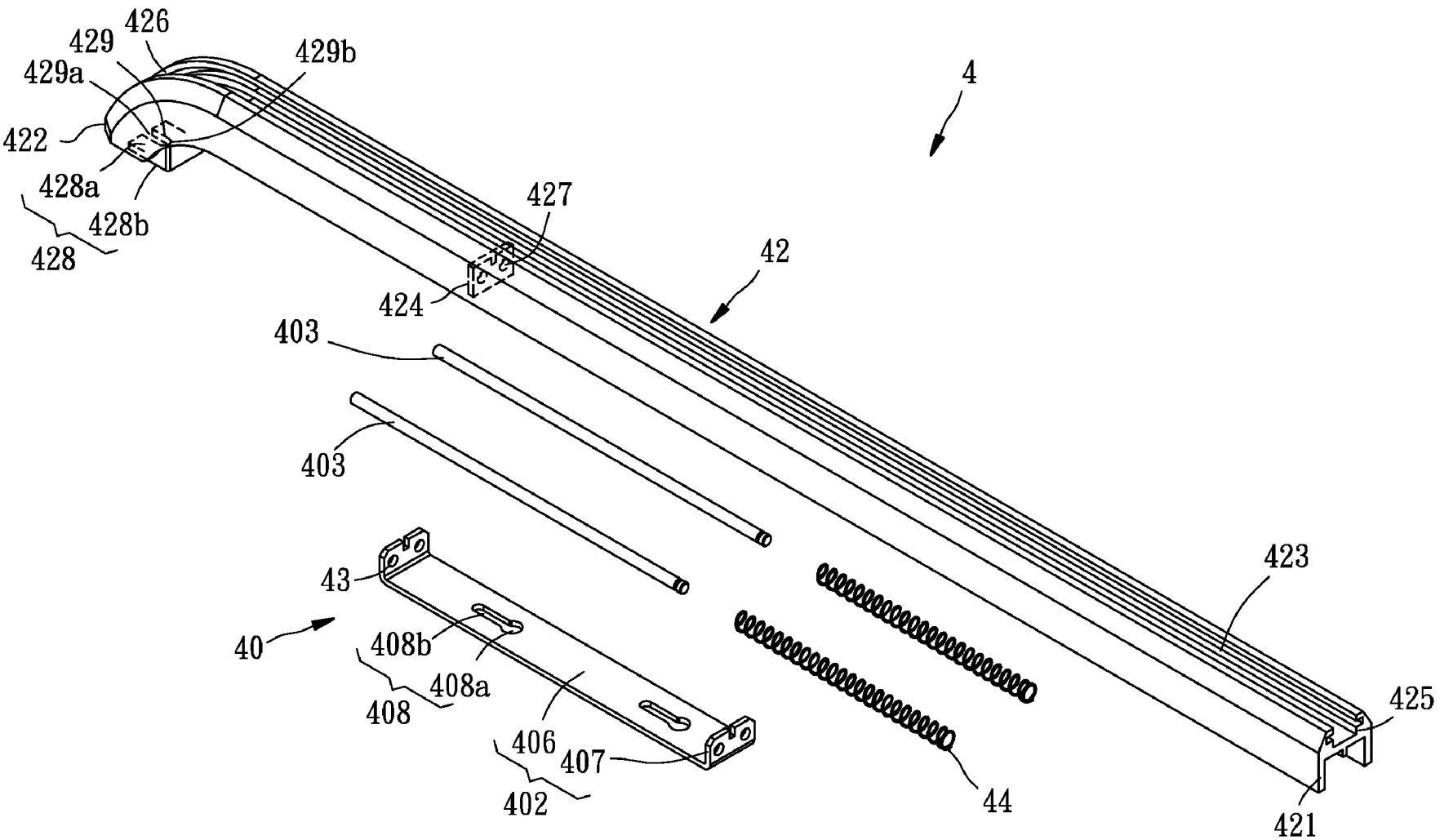
FIG. 3 is an exploded view of a part of the first preferred embodiment of the present invention.
Figure 4:
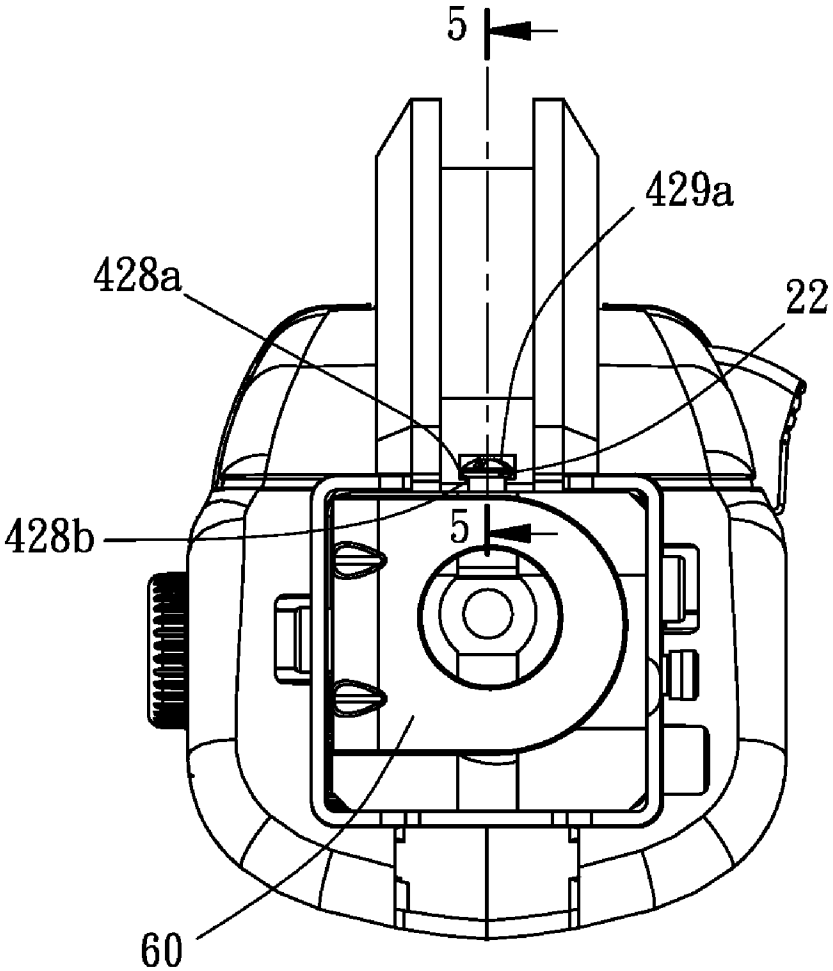
FIG. 4 is a side view of the first preferred embodiment of the present invention.
Figure 5:
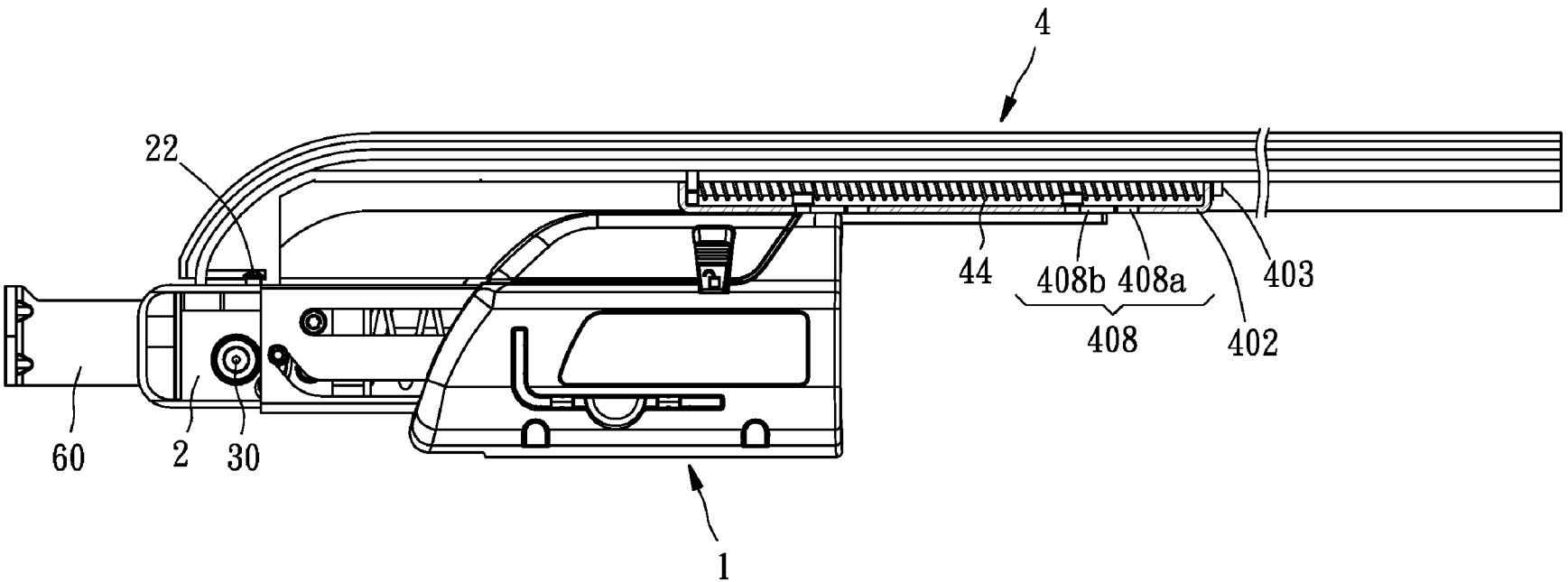
FIG. 5 is a sectional view taken from a line 5-5 indicated in FIG. 4.

Referring to FIG. 2, the base assembly 1 includes a base 10 and a slide rail 12. The base 10 has a coupling mechanism 14 having a coupling opening 141 into which a bit of a power screwdriver can be fitted. A variety of mechanisms like the coupling mechanism 14 can be found in the commercial automatic screw feeding devices respectively, such as U.S. Pat. No. 7,237,457 filed by the applicant of the present invention. The slide rail 12 is a rectangular barrel made of a metal plate by stamping, having an opening 121, a limit slot 122, and an action slot 123. The opening 121 is formed at one sidewall of the slide rail 12. The limit slot 122 and the action slot 123 are formed at the other sidewall of the slide rail 12. The action slot 123 has a first action portion 124 and a second action portion 125. The first and second action portions 124 and 125 define an included angle smaller than 180 degrees therebetween. In this embodiment, the included angle between the first and second action portions 124 and 125 is 120 degrees. The slide rail 12 is mounted to the base 10, having a part located in the base 10. The slide rail 12 is internally in communication with the coupling opening 141.

The slide assembly 2 includes a main body 20, a first limit member 22, a second limit member 24, and an aim member 60. The main body 20 is slidably mounted to the slide rail 12, movable forward and backward along a straight path between a first position and a second position. The main body 20 has a front end 201, a rear end 202 opposite to the front end 201, a passage 203, and a through hole 204, the latter two of which are formed therein. The passage 203 is close to the front end 201, defining a first inlet 205 and a first outlet 206, wherein the first inlet 205 is formed at one of two adjacent sidewalls of the front end 201 and the first outlet 206 is formed at the other sidewall of the front end 201. In this way, one end of a screw carrier can enter the passage 203 from the first inlet 205 and exit the passage 203 from the first outlet 206. The through hole 204 runs through the front end 201 and the rear end 202 respectively, in communication with the passage 203. When a screw carrier carrying screws enters the passage 203 and reaches a predetermined position in the passage 203, the bit of the power screwdriver, connected with the base assembly 1, can pass through the through hole 204 and then screw a screw located at the junction of the passage 203 and the through hole 204 onto a target. The first limit member 22 is a screw bolt having a body portion 221 and a head portion 222, wherein the body portion 221 has a thread. The first limit member 22 is threadably secured with the main body 20 at the sidewall where the opening 121 is located in such a way that the head portion 222 and a part of the body portion 221 are exposed outside the main body 20. The second limit member 24 is a hexagonal socket bolt screwed onto the main body 20, lying against one sidewall of the limit slot 122 to be located in the limit slot 122. In this way, the main body 20 is limited on the slide rail 12 for sliding only within the limit slot 122. The aim member 60 has an aim aperture 61 and is connected with the main body 20 to enable the aim aperture 61 to be located in front of the main body 20.

The first spring 6 is mounted in the slide rail 12, having one end stopped against the base 10 and the other end thereof stopped against the main body 20 for keeping the main body 20 located at the first position.

The screw carrier driving device 3 is mounted on the main body 20, having a drive wheel 30 and an action bolt 32. The action bolt 32 passes through the main body 20 to be located at the action slot 123. When the slide assembly 2 slides from the second position to the first position, the action bolt 32 slides from the second action portion 125 to the first action portion 124 to enable the drive wheel 30 to drive one screw carrier to move, a part of which is located in the passage 203, for a predetermined distance, thus completing the screw feeding operation. Such automatic screw carrier driving device has been broadly applied to a variety of commercial automatic screw feeding apparatuses, such as U.S. Patent Publication No. 2006/0033002 filed the applicant of the present invention.

Referring to FIGS. 2-5, the screw carrier guidance device 4 includes a connection member 40, a guide member 42, and two second springs 44. The connection member 40 has two connection pieces 401, a connection base 402, and two guide bars 403. Each of the two connection pieces 401 is a hexagonal socket bolt, having a body portion 404, a head portion 405, and a thread located on the body portion 404. The two connection pieces 401 are threadably secured with the base 10, each exposing its head portion 405 and a part of its body portion 404 outside the base 10. The connection base 402 is made of a metallic plate by stamping, having a body portion 406 and two limit portions 407. Each of the two limit portions 407 is located at one of two ends of the body portion 406, perpendicular to the body portion 406. The body portion 406 has two connection holes 408. The interval between the two connection holes 408 is identical to that of the two connection pieces 401. Each of the connection holes 408 has a wide portion 408*a* and a narrow portion 408*b*. When the head portions 405 of the two connection pieces 401 pass through the wide portions 408*a* of the two connection holes 408 respectively and then the connection base 402 is moved transversally, the exposed parts of the body portions 404 of the two connection pieces 401 are moved into the narrow portions 408*b* of the connection holes 408 respectively and then the connection base 402 is connected with the base 10. When the connection base 402 is moved transversally reversely, the exposed part of the body portions 404 are moved to the wide portions 408*a* respectively and then the connection base 402 can be detached from the base 10. The guide bars 403 each has two ends, each of which is fixed to one of the two limit portions 407, being parallel to each other.

The guide member 42 includes a first end 421, a second end 422, a guide groove 423, and a stopper 424. The guide groove 423 defines a second inlet 425 at the first end 421 and a second outlet 426 at the second end 422 for one end of a screw carrier to enter and exit the guide groove 423 respectively. The stopper 424 has two pores 427 fitted onto the two guide bars 403 respectively, such that the guide member 42 is connected with the connection member 40 in such a way that the guide member 42 is movable forward and backward between a third position and a fourth position on the connection member 40. When the guide member 42 is located at the third position, the second outlet 426 is located close to the first inlet 205 of the slide assembly 2 to enable one end of a screw carrier to smoothly enter the passage 203 through the first inlet 205. The guide member 42 has a contact portion 428 at a front end thereof and having a first surface 428*a* and a second surface 428*b*; and an open slot 429 running through the first and second surfaces 428*a* and 428*b* and having a slot opening 429*a* and a slot bottom 429*b*. When the connection base 402 is connected with the base 10, the open slot 429 of the guide member 42 is connected with the first limit member 22. When the guide member 42 is located at the third position, the slot bottom 429*b* is stopped against the exposed part of the body portion 221 of the first limit member 22.

The two second springs 44 are fitted onto the two guide bars 403 respectively, each having two ends, one of which is stopped against one side of one of the limit portions 407 of the connection base 402 and the other end thereof is stopped against one corresponding side of the stopper 424 respectively.

Figure 6:
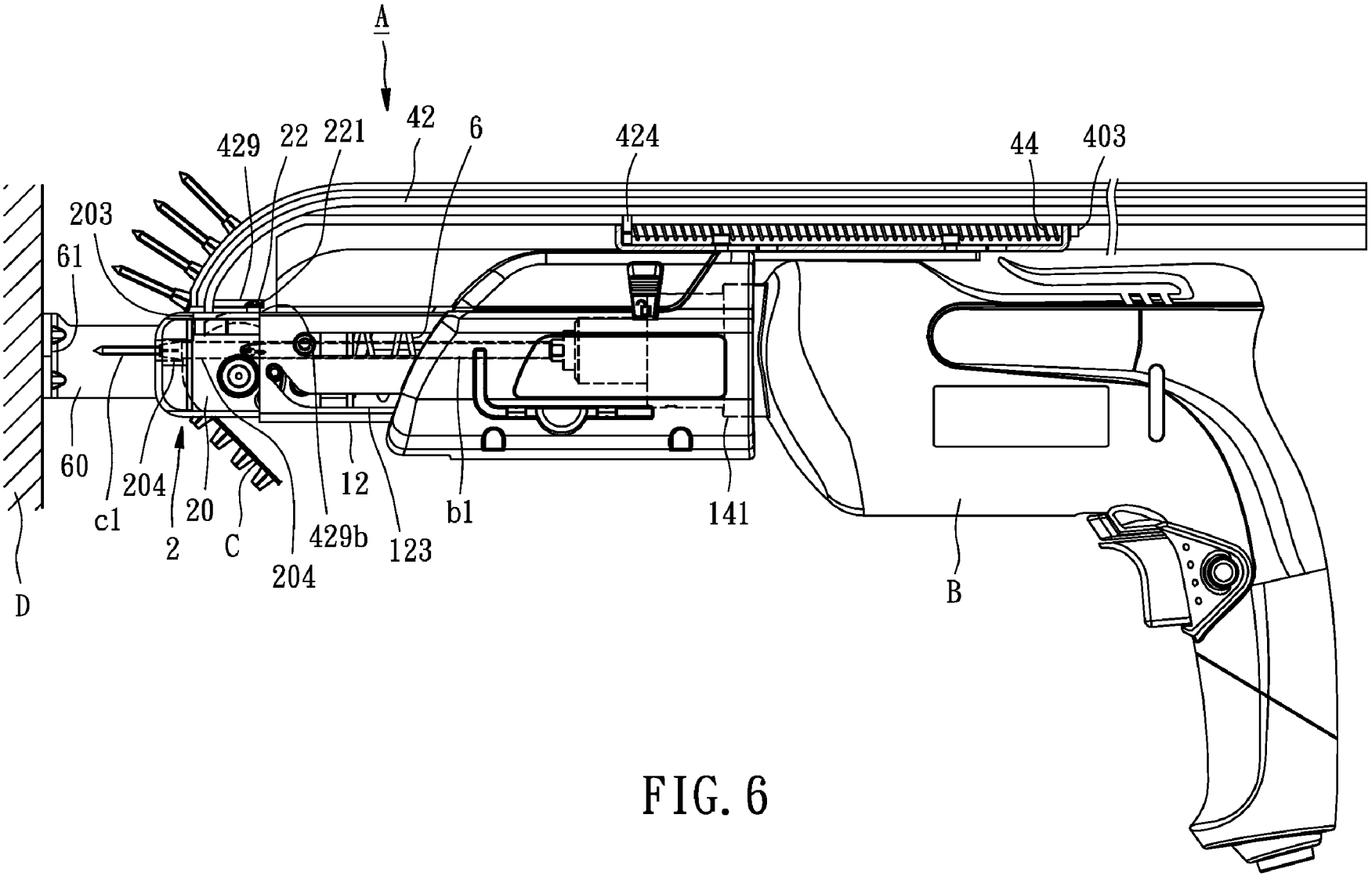
FIGS. 6-8 illustrate the present invention combined with a power screwdriver in operation.
Figure 7:
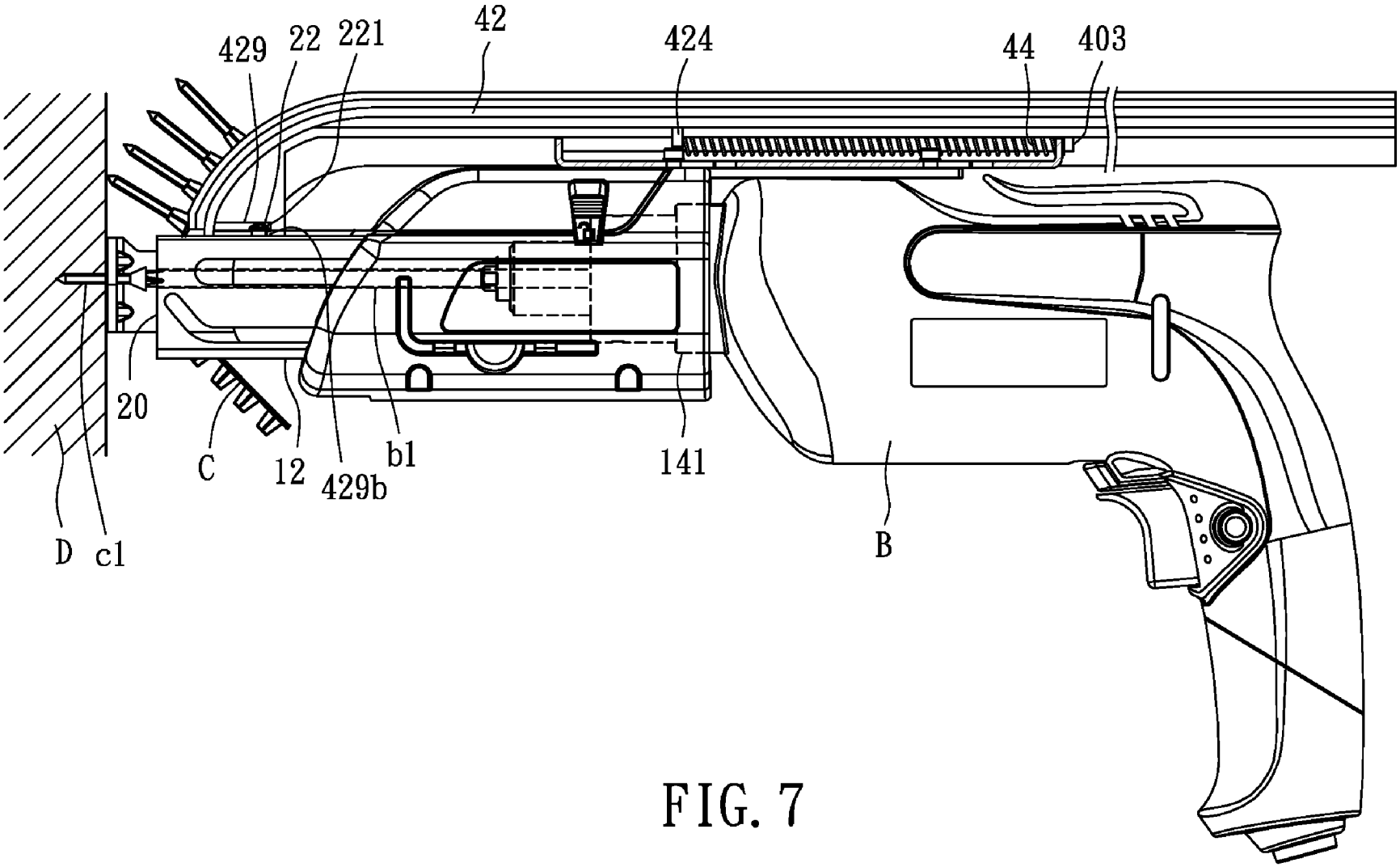
Figure 8:
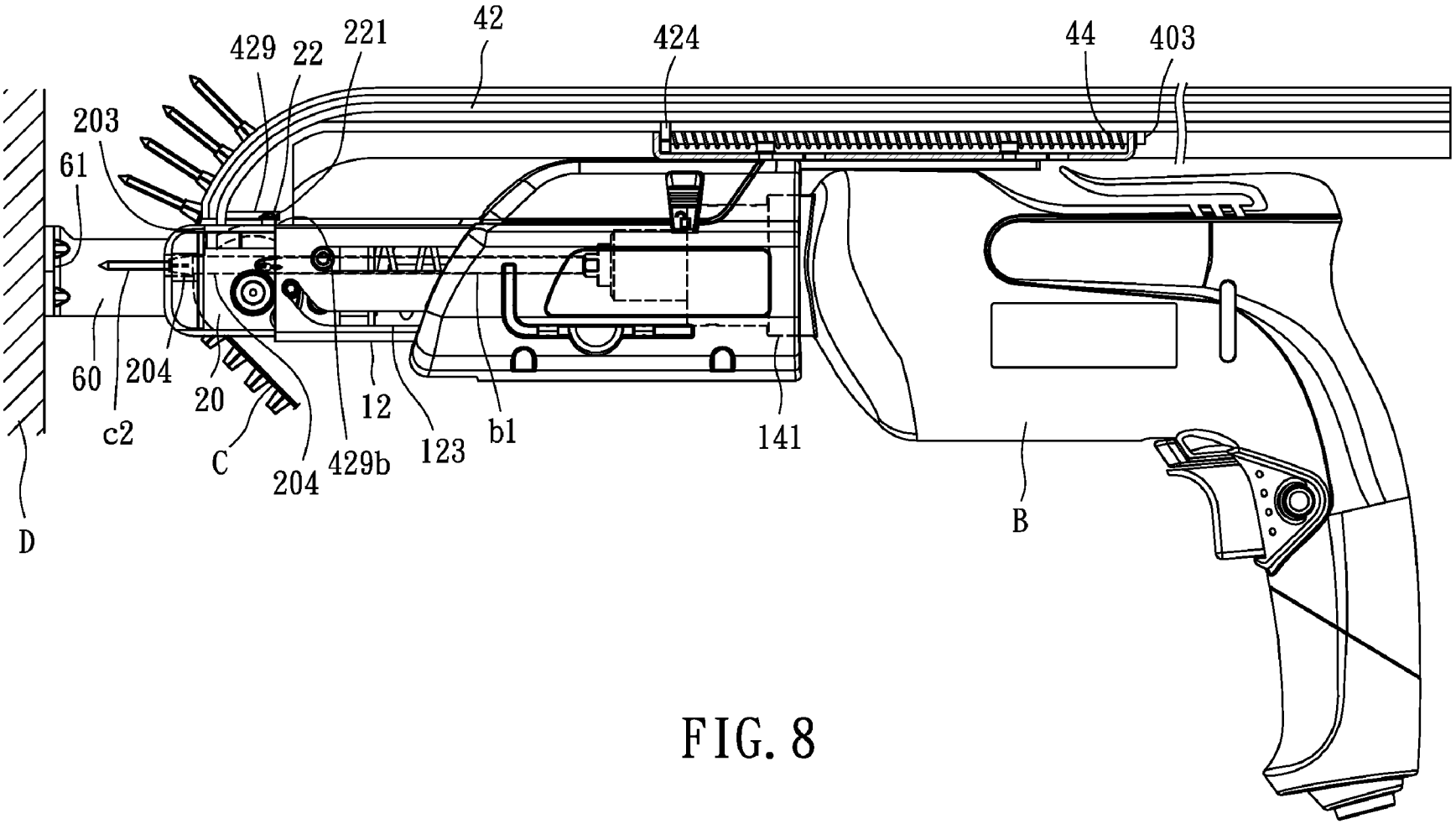

Referring to FIGS. 6-8, while operating the automatic screw feeding apparatus A, the user inserts a head end of a power screwdriver B into the coupling opening 141 to enable the automatic screw feeding apparatus A to be connected with the power screwdriver B and to enable a drive bit b1 of the power screwdriver B to be located in the through hole 204 of the slide assembly 2, to be aligned with a screw carrier C located in the passage 203, and to face a screw c1 located in front of itself. In normal condition, the slide assembly 2 is located at the first position and the guide member 42 is located at third position, as shown in FIG. 6.

When the aim member 60 is stopped against a workpiece D intended to be threadably secured with a screw, after a center of the aim aperture 61 is aligned with the screw, press the power screwdriver B toward the workpiece D to drive the slide assembly 2 to move along the slide rail 12 toward the second position. During the operation, the slide assembly 2 carries the screw carrier C and the screw c1 located on the screw carrier C and facing the drive bit b1 to be moved together to the second position. In the meantime, the slide assembly 2 is stopped against the slot bottom 429*b* of the open slot 429 by the body portion 221 of the first limit member 22 to push the guide member 42 to move from the third position to the fourth position. The movement of the guide member 42 enables the sliding of the stopper 424 on the two guide bars 403 and compresses the two second springs 44 on the two guide bars 403. When the slide assembly 2 is moved to the second position, a head end of the drive bit b1 is stopped against a head end of the screw c1 facing and located in front of the head end of the drive bit b1. Next, the tip of the screw c1 contacts the surface of the workpiece D and meanwhile, when the user turns on the power screwdriver b and pushes the trigger thereof, the drive bit b1 is activated to drive the screw c1 to be screwed into the workpiece D, as shown in FIG. 7, until the slide assembly 2 reaches the second position, i.e. the guide member 42 reaches the fourth position.

After the screw c1 is screwed with the workpiece D, the user stops pushing the trigger, slide assembly 2 is pushed by the resilience of the first spring 6 to slide toward the first position. When the slide assembly 2 is moved to the first position, the action bolt 32 is moved along the action slot 123 to drive rotation of the drive wheel 30 to further drive the screw carrier C to move forward. When the slide assembly 2 is moved to the first position, another screw c2 in succession to the screw c1 is driven by the screw carrier C to be located at the position in front of the drive bit b1, as shown in FIG. 8. Because the screw carrier driving device 3 has been broadly applied to a variety of the commercial automatic screw feeding apparatuses, it is not necessary to recite how the action bolt 32 drives the drive wheel 30 to rotate and how the drive wheel 30 drives the screw carrier C to move forward.

However, it is to be noted that the guide member 42 is moved along the two guide bars 403 from the fourth position to the third position, when the slide assembly 2 is moved from the second position to the first position, because the two second springs 44 apply their resilience to the stopper 424. The required force pushing the guide member 42, the screw carrier C carried on the guide member 42, and the screws to move from the fourth position to the third position is burdened by the two second springs 44 to greatly decrease the burden of the first spring 6. In this way, the restitution of the slide assembly 2 and the guide member 42 is enhanced, the driven forward movement of the screw carrier C by the drive wheel becomes more smooth, and the screw jam resulted from failure of driving the screw carrier by the drive wheel 30 is avoided.

Figure 9A:
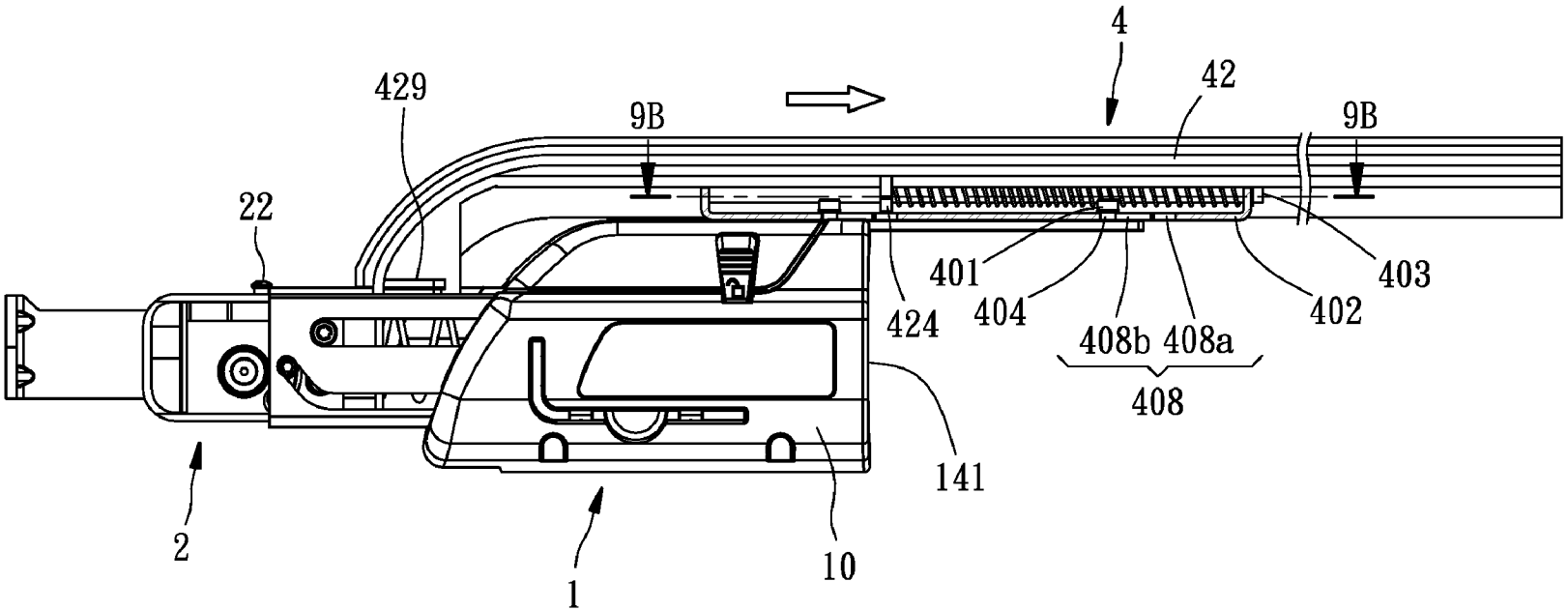
FIG. 9A is another side view of the first preferred embodiment of the present invention at work.
Figure 9B:
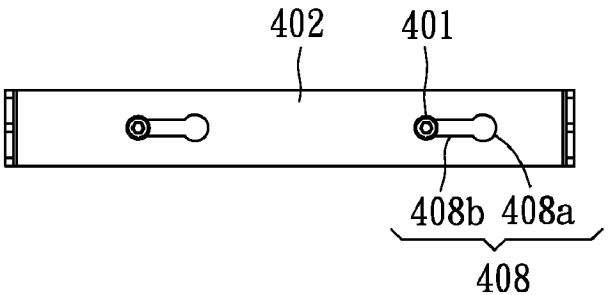
FIG. 9B is a sectional view taken from a line 9B-9B indicated in FIG. 9A.
Figure 10A:
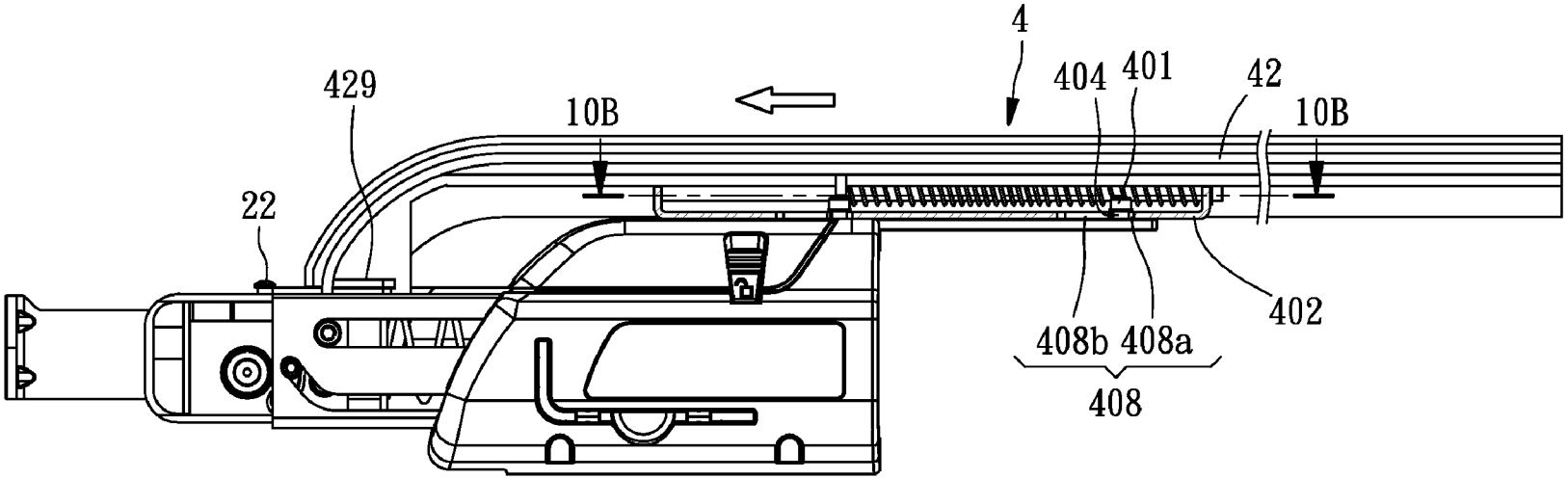
FIG. 10A is another side view of the first preferred embodiment of the present invention at work.
Figure 10B:
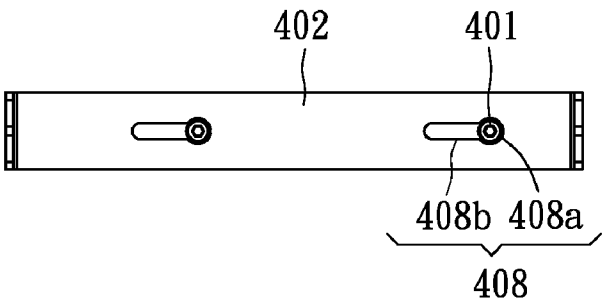
FIG. 10B a sectional view taken from a line 10B-10B indicated in FIG. 10A.
Figure 11:
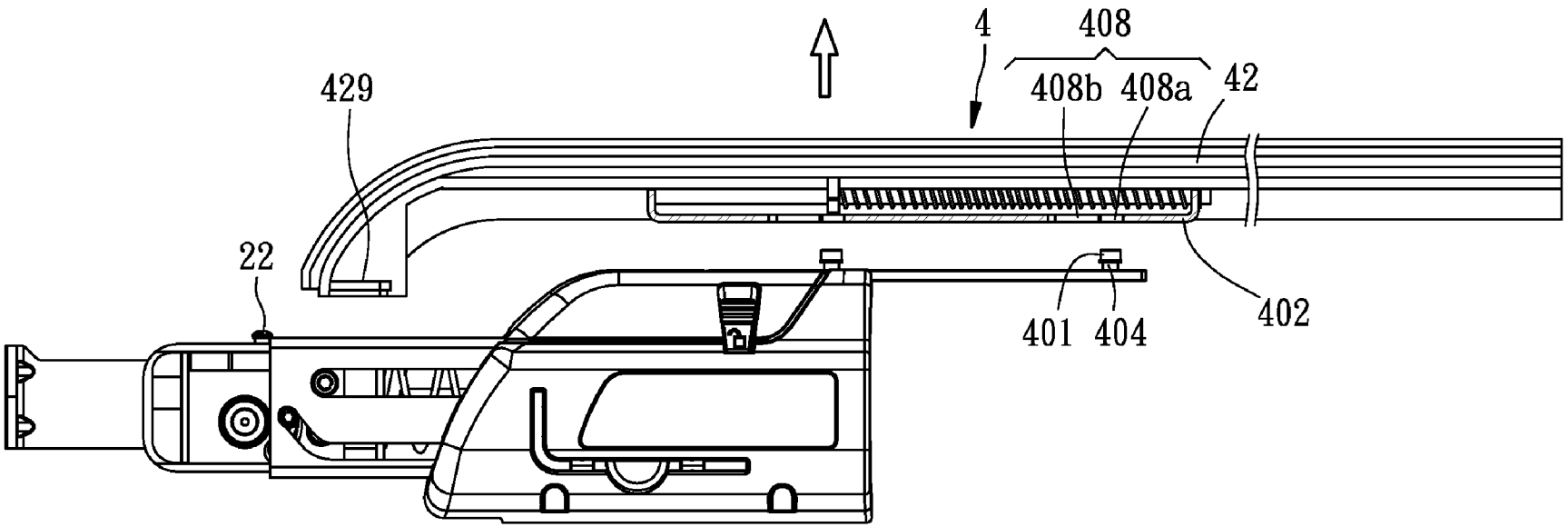
FIG. 11 is another side view of the first preferred embodiment of the present invention at work.
Figure 12:
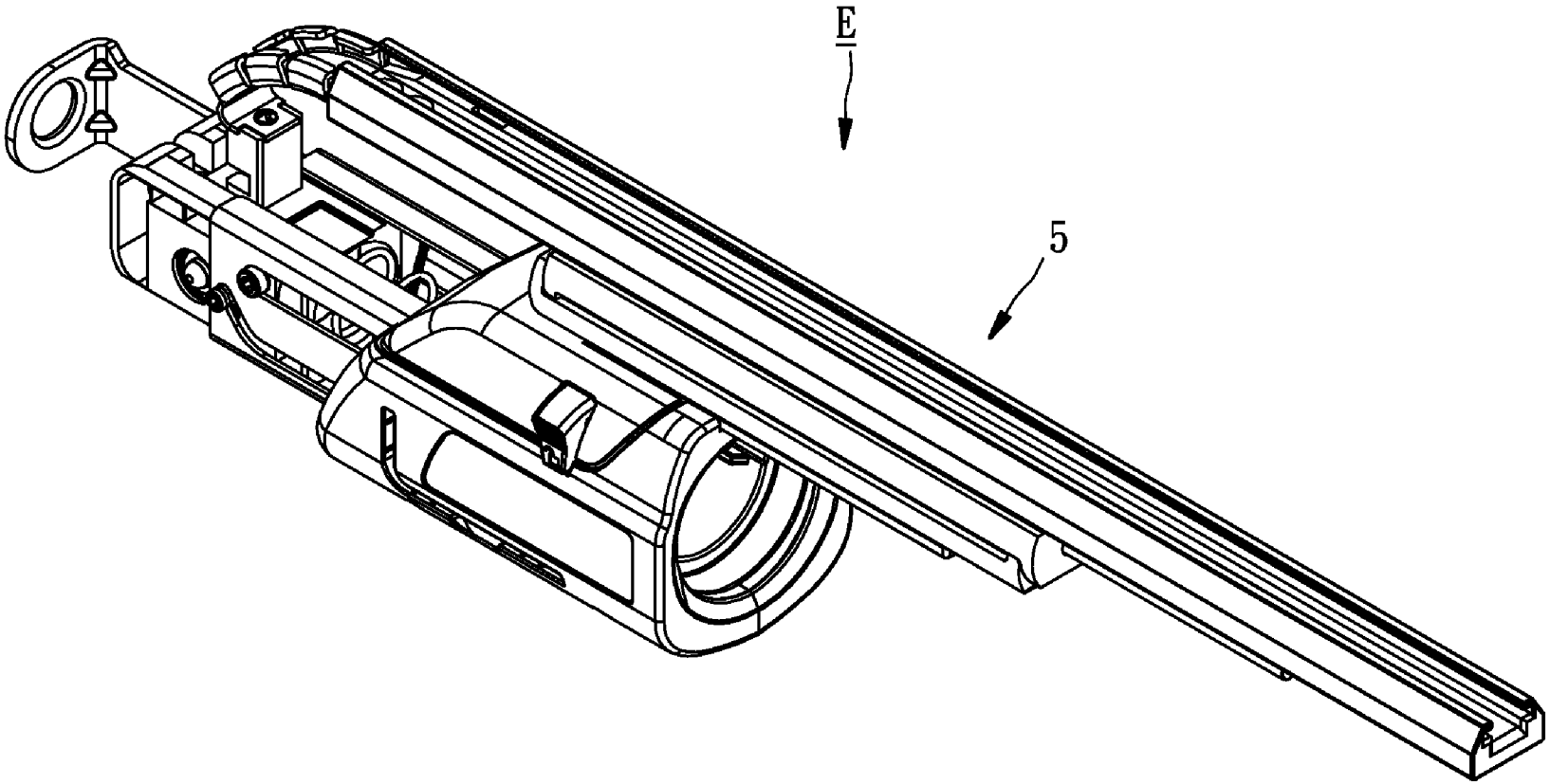
FIG. 12 is a perspective view of a second preferred embodiment of the present invention.

Referring to FIGS. 9-11, the automatic screw feeding apparatus A includes an innovative effect that the conventional one did not have. Specifically, the screw carrier guidance device 4 can be detached from and installed to the base assembly 1 and the slide assembly 2 easily, quickly, and without any tool. The screw carrier guidance device 4 can be detached from the base assembly 1 and the slide assembly 2 according to the following steps. First, apply a force toward the coupling opening 141 of the base assembly 1 to the guide member 42 to drive the guide member to move toward the same direction and to the open slot 429 of the guide member 42 to disengage from the first limit member 22; meanwhile, the stopper 424 slides along the two guide bars 403 for a predetermined distance to compress the two second springs 44, as shown in FIGS. 9A & 9B. Next, push the connection base 402 reversely to enable the body portions 404 of the two connection pieces 401 to disengage from the narrow portions 408*b* and then to enter the wide portions 408*a* respectively, as shown in FIGS. 10A and 10B. Finally, lift the screw carrier guidance device 4 upward away from the base assembly 1 and the slide assembly 2, as shown in FIG. 11. Do the above steps to the contrary, the screw carrier guidance device 4 can be installed to the base assembly 1 and the slide assembly 2. In this way, the user conveniently carries the automatic screw feeding apparatus A, such that the package of the automatic screw feeding apparatus A can be preferably small to reduce the delivery cost thereof.

To enable the present invention to be applied to different types of the power screwdrivers for the same objections and effects, an automatic screw feeding apparatus E constructed in accordance with a second preferred embodiment of the present invention is presented. The automatic screw feeding apparatus E is similar to the automatic screw feeding apparatus A, having the difference focused on the screw carrier guidance device 5.

Figure 13:
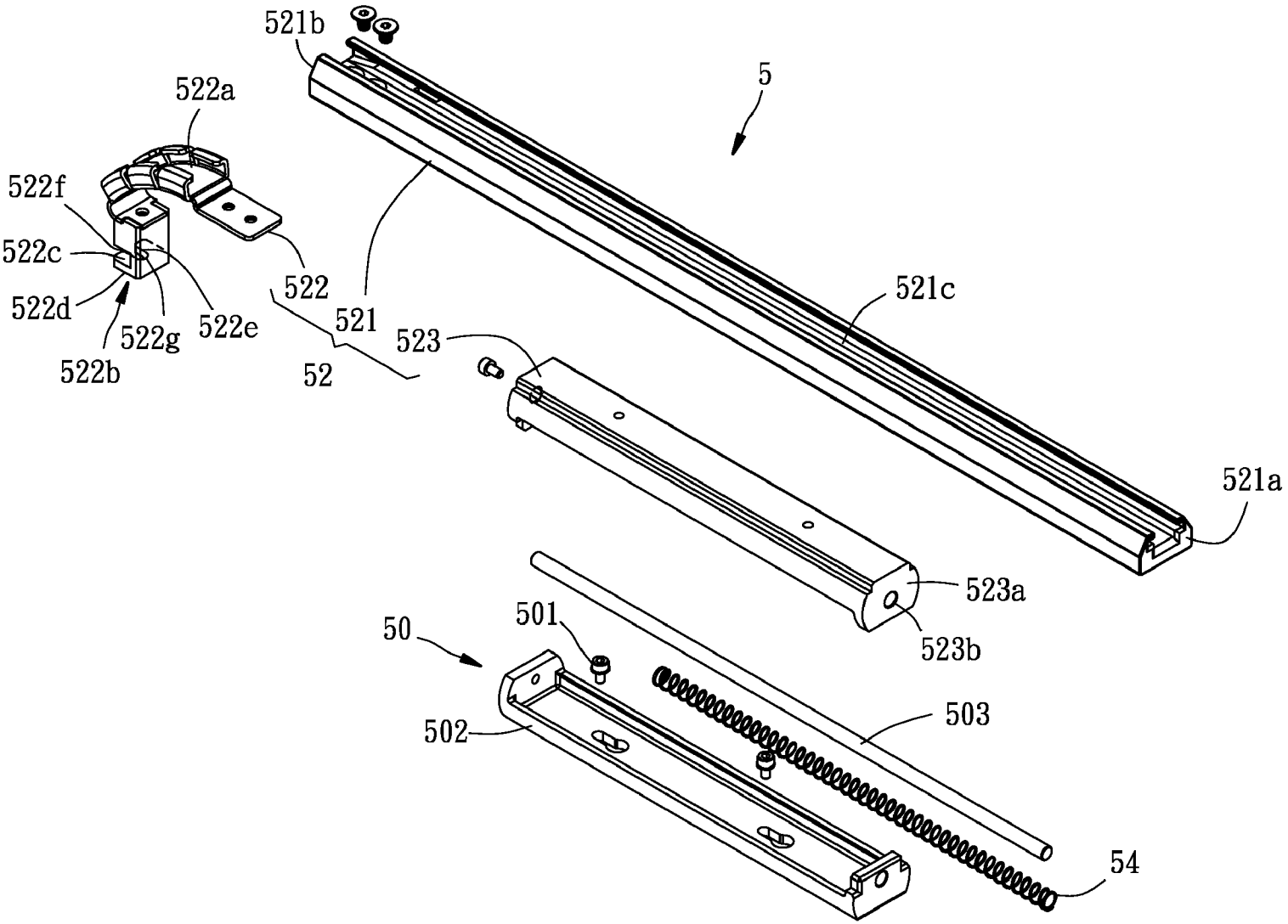
FIG. 13 is an exploded view of a part of the second preferred embodiment of the present invention.

Referring to FIG. 13, the screw carrier guidance device 5 is composed of a connection member 50, a guide member 52, and a spring 54. The connection member 50 includes two connection pieces 501, a connection base 502, and a guide bar 503. The connection pieces 501, the connection base 502, and the guide bar 503 are identical to those of the first embodiment, so that their detailed recitations are skipped.

The guide member 52 includes a guide rail 521, a coupling portion 522, and a base 523. The guide rail 521 has one end defined as a first end 521*a* of the guide member 52 and the other end thereof defined as a connection end 521*b*. The coupling portion 522 has one end connected with the connection end 521*b* of the guide rail 521 and the other end defined as a second end of the guide member 52. The guide rail 521 has a primary guide groove 521*c*. The coupling portion 522 has a secondary guide groove 522*a* for connection with and in communication with the primary guide groove 521*c*; in this way, the primary and secondary guide grooves 521*c* and 522*a* jointly work for the guide member 52. The coupling portion 522 has a contact portion 522*b* having a first surface 522*c*, a second surface 522*d*, and an open slot 522*e* running through the first and second surfaces 522*c* and 522*d* and having a slot opening 522*f* and a slot bottom 522*g*. When the connection member 50 is connected with the base 10, the open slot 522*e* can be connected with the first limit member 22. When the guide member 52 is located at the third position, the slot bottom 522*g* of the open slot 522*e* is stopped against the exposed part of the body portion 221 of the first limit member 22. The base 523 is connected with a bottom side of the guide rail 521, having two stoppers 523*a*, each of which has a through hole 523*b*. Each of the through holes 523*b* is fitted onto the guide bar 503 and thus the base 523 is slidable on the guide bar 503 together with the guide rail 521 and the coupling portion 522. The spring 54 is a tension spring mounted between the connection member 50 and the base 523.

Although the screw carrier guidance device 5 of the second embodiment is different from that of the first embodiment, they have the same effects.

Figure 14:
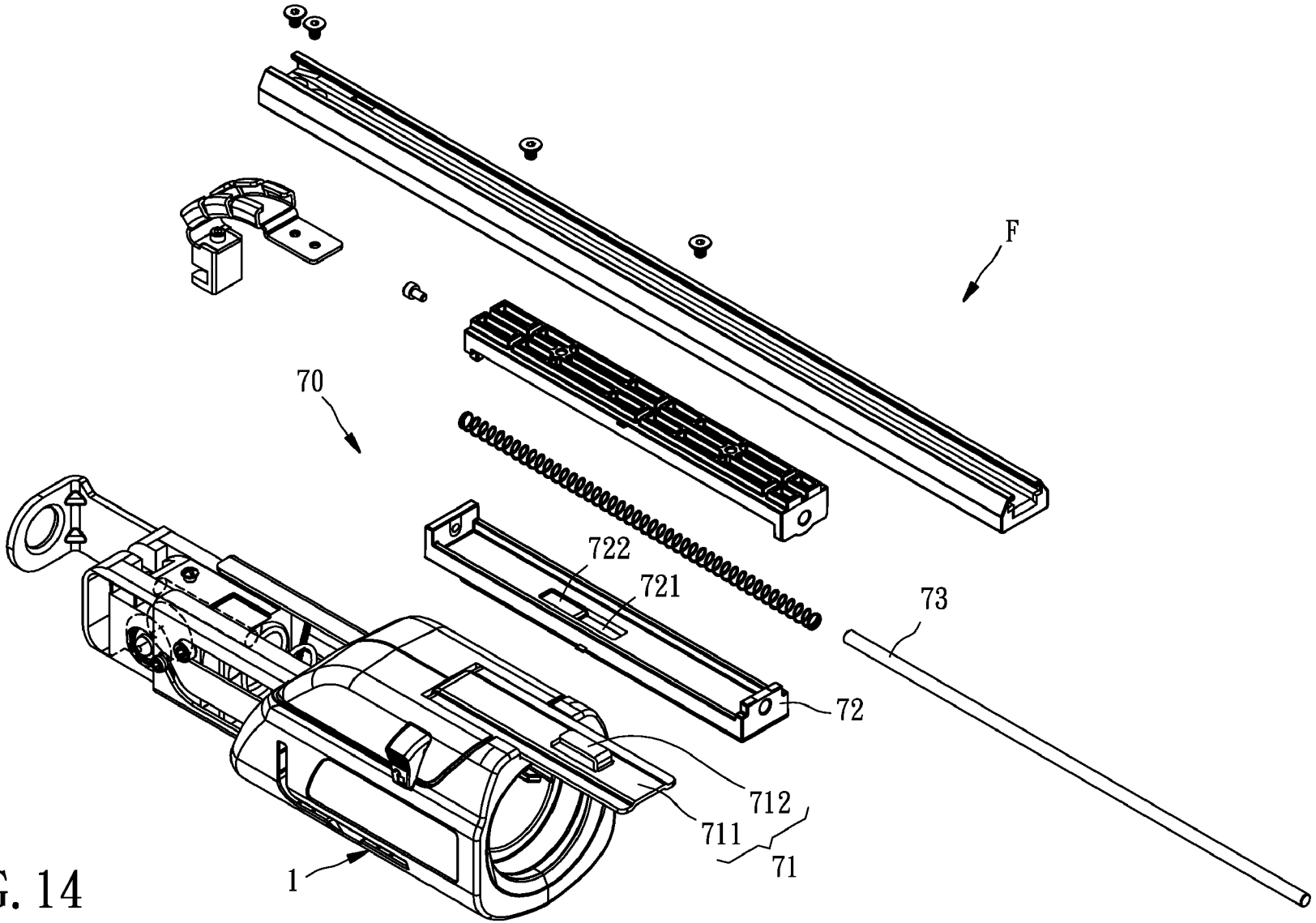
FIG. 14 is a partial exploded view of a third preferred embodiment of the present invention.

Referring to FIG. 14, an automatic screw feeding apparatus F constructed according to a third preferred embodiment of the present invention includes a connection member 70. The connection member 70 has a connection piece 71, a connection base 72, and a guide bar 73. The connection piece 71 is made of a metallic plate by stamping and mounted to the base assembly 1, having a body portion 711 and a hooked portion 712. The connection base 72 has a through hole 721 and a connection portion 722 located adjacent to the through hole 721. The guide bar 73 is mounted onto the connection base 72. The other components and their interrelationships of the third embodiment are identical to those of the second embodiment, so that no more recitation is necessary.

Figure 15:
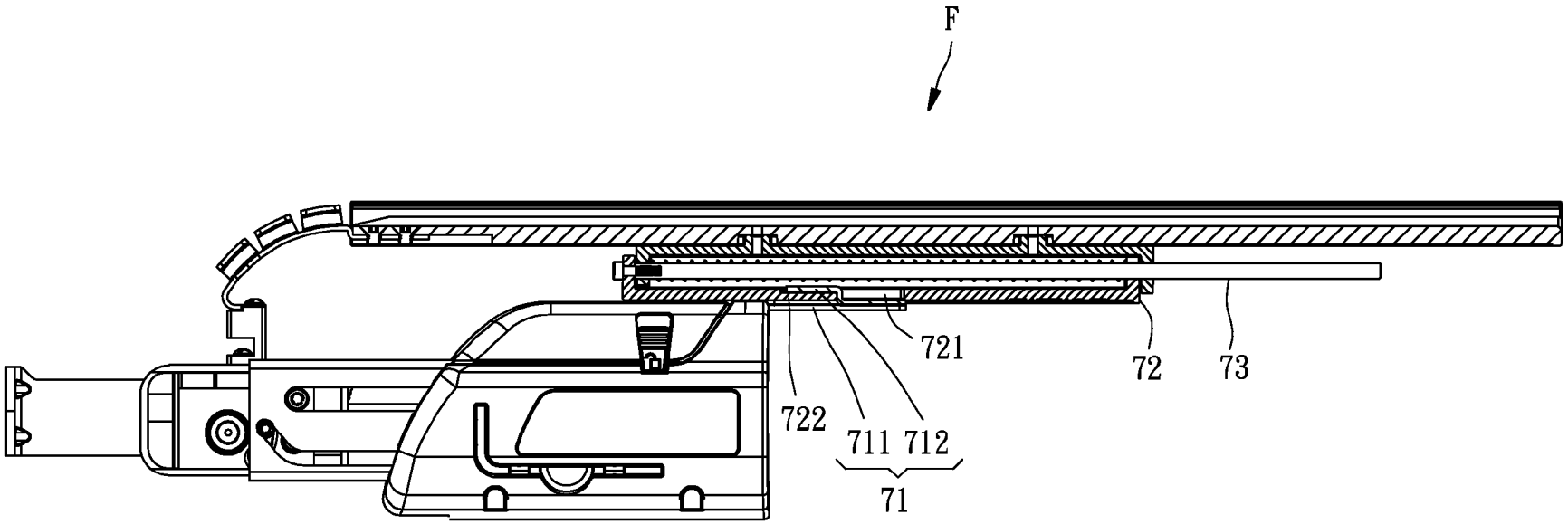
FIG. 15 is partially sectional side view of third preferred embodiment of the present invention.

Referring to FIG. 15, the connection base 72 is connected with the connection piece 71 in such a way that the hooked portion 712 of the connection piece 71 passes through the through hole 721 and the connection portion 722 is held between the hooked portion 712 and the body portion 711.

Although the connection member 70 of the second embodiment is different from those of the aforementioned embodiments, they have the same effects.

Although the present invention has been described with respect to a specific preferred embodiment thereof, it is no way limited to the details of the illustrated structures but changes and modifications may be made within the scope of the appended claims.

What is claimed is:

1. An automatic screw feeding apparatus for a power screwdriver, comprising:

a base assembly for connection with the power screwdriver;

a slide assembly slidably mounted to said base assembly for forward and backward movement between a first position and a second position along a straight path, said slide assembly having a passage defining a first inlet and a first outlet, whereby a screw carrier can enter said passage from said first inlet and exit said passage from said first outlet;

a first spring mounted between said base assembly and said slide assembly for keeping said slide assembly located at the first position;

a screw carrier driving device mounted on said slide assembly and movable from the second position to the first position, for driving a screw carrier to move along said passage for a distance, said screw carrier having a part located in said passage; and a screw carrier guidance device having a connection member, a guide member, and at least one second spring, said connection member being connected with said base assembly, said guide member having a first end, a second end, and a guide groove, said guide groove defining a second inlet and a second outlet at the first end and the second end of said guide member respectively, whereby a screw can enter said guide groove from said second inlet and exit said guide groove from said second outlet; said guide member being mounted to said connection member for forward and backward movement between a third position and a fourth position, when said guide member is located at the third position, said second outlet is located close to said first inlet of said slide assembly to enable a screw to smoothly enter said passage from said second outlet of said guide member through said first inlet; said at least one second spring being mounted between said guide member and said connection member for keeping said guide member located at the third position.

2. The automatic screw feeding apparatus as defined in claim 1, wherein said connection member comprises two guide bars, and said guide member comprises two through holes being fitted onto said two guide bars respectively, whereby said guide member is movable forward and backward between the third and fourth positions.

3. The automatic screw feeding apparatus as defined in claim 2, wherein said guide member comprises at least one stopper, and said through holes running through said at least one stopper.

4. The automatic screw feeding apparatus as defined in claim 3, wherein said slide assembly comprises a main body and a first limit member, said main body being slidably mounted to said base assembly and movable forward and backward between the first and second positions, said first limit member being a bolt having a body portion, a head portion, and a thread located at said body portion, said first limit member being threadably secured with said main body, said head portion and a part of said body portion of said first limit member being exposed outside said main body, said guide member having a contact portion located at a front end thereof, said contact portion having a first surface, a second surface, and an open slot running through said first and second surfaces, said open slot having a slot opening and a slot bottom, said open slot of said guide member being adapted for connection with said first limit member; when said guide member is located at the third position, said slot bottom of said open slot is stopped against the exposed part of said body portion of said first limit member.

5. The automatic screw feeding apparatus as defined in claim 4, wherein said guide member comprises a guide rail, a coupling portion, and a base, said guide rail having two ends, one of which is said first end of said guide member and the other end thereof defines a coupling end, said coupling portion having an end connected with said coupling end of said guide rail and the other end thereof defining a second end of said guide member, said contact portion being located at said coupling portion, said guide rail having a primary guide groove, said coupling portion having a secondary guide groove for connection with and in communication with said primary guide groove, said primary and secondary guide grooves jointly working for said guide member, said base being connected with a bottom side of said guide rail, said guide member having two stoppers mounted to said base.

6. The automatic screw feeding apparatus as defined in claim 2, wherein said connection member further comprises a connection base connected with said base assembly, and said guide bars are connected with said connection base.

7. The automatic screw feeding apparatus as defined in claim 6, wherein said connection member further comprises two connection pieces for connecting said connection member to said base assembly.

8. The automatic screw feeding apparatus as defined in claim 7, wherein each of said two connection pieces is a hexagonal socket bolt having a body portion, a head portion, and thread formed on said body portion, said two connection pieces being threadably secured with said base assembly, said head portion and a part of said body portion of every said connection piece being exposed outside said base assembly; said connection base comprises two connection holes, whose distance therebetween is identical to that of said two connection pieces, each of said connection holes having a wide portion and a narrow portion, whereby when said head portions of said two connection pieces pass through said wide portions of said two connection holes respectively and then said connection base is moved transversally to move the exposed parts of said body portions of said two connection pieces to said narrow portions of said two connection holes, said connection base can be connected with said base assembly; when the exposed parts of said body portions of said two connection pieces are moved to said wide portions of said two connection holes and then said connection base is moved upward with respect to said base assembly, said connection base can be detached from said base assembly.

9. The automatic screw feeding apparatus as defined in claim 8, wherein said connection base is made of a metallic plate by stamping and comprises a body portion and two limit portions, each of which is located at one of two ends of said body portion of said connection base and perpendicular to said body portion of said connection base; said two connection holes is located at said body portion of said connection base; and each of said guide bars comprises two ends, each of which is fixed to one of said limit portions.

10. The automatic screw feeding apparatus as defined in claim 9, wherein said guide member comprises at least one stopper; said through holes of said guide member run through said at least one stopper; and said at least one second spring is fitted onto said guide bars, each of said at least one second spring having two ends, one of which is stopped against a side of one of said limit portions of said connection base and the other end thereof is stopped against a corresponding side of said stopper respectively.

11. The automatic screw feeding apparatus as defined in claim 1, wherein said connection member comprises a guide bar having two through holes, said through holes being fitted onto said guide bar, whereby said guide member is movable forward and backward between the third and fourth positions.

12. The automatic screw feeding apparatus as defined in claim 11, wherein said guide member comprises two stoppers, and said through holes run through said stoppers respectively.

13. The automatic screw feeding apparatus as defined in claim 11, wherein said connection member further comprises a connection base connected with said base assembly, and said guide bar is connected with said connection base.

14. The automatic screw feeding apparatus as defined in claim 13, wherein said connection member further comprises two connection pieces for connecting said connection member to said base assembly.

15. The automatic screw feeding apparatus as defined in claim 14, wherein each of said two connection pieces is a hexagonal socket bolt having a body portion, a head portion, and thread formed on said body portion, said two connection pieces being threadably secured with said base assembly, said head portion and a part of said body portion of every said connection piece being exposed outside said base assembly; said connection base comprises two connection holes, whose distance therebetween is identical to that of said two connection pieces, each of said connection holes having a wide portion and a narrow portion, whereby when said head portions of said two connection pieces pass through said wide portions of said two connection holes respectively and then said connection base is moved transversally to move the exposed parts of said body portions of said two connection pieces to said narrow portions of said two connection holes, said connection base can be connected with said base assembly; when the exposed parts of said body portions of said two connection pieces are moved to said wide portions of said two connection holes and then said connection base is moved upward with respect to said base assembly, said connection base can be detached from said base assembly.

16. The automatic screw feeding apparatus as defined in claim 15, wherein said connection base is made of a metallic plate by stamping and comprises a body portion and two limit portions, each of which is located at one of two ends of said body portion and perpendicular to said body portion; said two connection holes are located at said body portion of said connection base.

17. The automatic screw feeding apparatus as defined in claim 16, wherein said guide member comprises at least one stopper; said through holes of said guide member run through said at least one stopper; and said at least one second spring is a tension spring fitted onto said guide bar and having two ends, one of which is stopped against a side of one of said limit portions of said connection base and the other thereof is stopped against a corresponding side of said stopper.

18. The automatic screw feeding apparatus as defined in claim 1, wherein said slide assembly comprises a main body and a first limit member, said main body being slidably mounted to said base assembly and movable forward and backward between the first and second positions, said first limit member being a bolt having a body portion, a head portion, and a thread located at said body portion, said first limit member being threadably secured with said main body, said head portion and a part of said body portion of said first limit member being exposed outside said main body, said guide member having a contact portion located at a front end thereof, said contact portion having a first surface, a second surface, and an open slot running through said first and second surfaces, said open slot having a slot opening and a slot bottom, said open slot of said guide member being adapted for connection with said first limit member; when said guide member is located at the third position, said slot bottom of said open slot is stopped against the exposed part of said body portion of said first limit member.

19. The automatic screw feeding apparatus as defined in claim 1, wherein said connection member comprises a connection piece, a connection base, and a guide bar, said connection piece is made of a metallic plate by stamping and fixed to said base assembly, said connection piece having a body portion and a hooked portion, said connection base having a through hole and a connection portion located adjacent to said through hole, said connection portion being held between said body portion and said hooked portion, said guide member having two through holes fitted onto said guide bar to enable said guide member to be moved forward and backward between the third and fourth positions.

* * * * *